United States Patent [19]

Brose

[11] 4,400,267

[45] Aug. 23, 1983

[54] SEAL STRUCTURE FOR HYDROCYCLONES

[75] Inventor: Donald D. Brose, Park City, Utah

[73] Assignee: Baker International Corporation, Salt Lake City, Utah

[21] Appl. No.: 289,530

[22] Filed: Aug. 3, 1981

[51] Int. Cl.[3] ..... B04C 5/14

[52] U.S. Cl. ..... 209/211; 285/260; 285/420

[58] Field of Search ..... 209/211; 285/260, 332.1, 285/420

[56] References Cited

U.S. PATENT DOCUMENTS

| | | | |
|---|---|---|---|
| 2,816,658 | 12/1957 | Braun et al. | 209/211 |
| 2,953,248 | 9/1960 | Troland | 209/211 |
| 3,039,608 | 6/1962 | Wikdahl | 209/211 |
| 3,136,723 | 6/1964 | Erwin et al. | 209/211 |
| 4,053,393 | 10/1977 | Day et al. | 209/211 |
| 4,148,721 | 4/1979 | Brown et al. | 209/211 |
| 4,226,707 | 10/1980 | Boivin | 209/211 |

*Primary Examiner*—Tim R. Miles

*Attorney, Agent, or Firm*—Trask & Britt

[57] ABSTRACT

A hydrocyclone is provided with tapered surfaces at the perimeters of the accept head and the lower cone to effect a double taper seal when the head and cone sections are clamped together in assembled condition.

8 Claims, 2 Drawing Figures

SEAL STRUCTURE FOR HYDROCYCLONES

BACKGROUND OF THE INVENTION

1. Field

This invention relates to the sealing of the accept head portion to the lower cone portion of a hydrocyclone and is particularly directed to an improved sealing structure for hydrocyclone constructed of a resinous material such as polyurethane.

2. State of the Art

Cyclone-type centrifugal separators are well known. They are widely used for separating a fluid suspension of solids into light and heavy fractions. When the suspending fluid is liquid, these devices are commonly called hydrocyclone.

Hydrocyclone are commonly used in connection with oil rigs as desanders, desilters and for the recovery of barite salvage.

A hydrocyclone typically includes an accept head which connects to a centrifugal pump to accept mud through a tangential opening. The mud or slurry thus assumes a whirling motion within the accept head. The accept head connects to the large end of a lower cone. The whirling stream of fluid progresses downward toward the small end or apex of the cone body. In the process, the larger heavier particles are thrown out toward the interior surface of the cone, and the finer lighter particles tend to remain as part of the fluid mass near the center of the cone. Eventually, the larger particles and a small amount of fluid move to the bottom of the cone and pass out the apex as underflow. The remainder of the fluid, which contains the smaller particles, reverses direction and passes back up through the center of the accept head as overflow or effluent.

Dynamically, the flow inside the lower cone comprises a downward spiral adjacent the interior surface of the lower cone, and an upward spiral about the central axis of the cone. These two countercurrent flows generate edy currents which result in turbulent flow conditions.

The dyanamic hydraulic conditions required for proper operation of a hydrocyclone often involve operation at elevated pressures; e.g., above about 40 psi. Often much higher pressures, typically in excess of about 70 psi, are experienced intermittently due to hydraulic surges within the system. Hydrocyclone currently available within the art characteristically leak around the sealing surface between the head section and lower cone section, particularly during surge conditions.

In the case of polyurethane hydrocyclone used in the drilling industry for desanding, desilting, degasing and other surface mud handling operations, a circumferential clamping band is the usual means employed for forcing the sealing surface of the head section against the sealing surface of the lower cone. Considerable mechanical force is applied through the clamp, but even so, leakage has remained a problem. Various configurations have been applied to the mating sealing surfaces of the head section and lower cone section to help alleviate the leakage problem. For example, some manufacturers have provided a circumferential recess at the top of the lower cone section which functions as a socket to receive a depending circumferential projection (plug) from the head section. The projection and socket cooperatively form a male/female connection which is held firmly engaged by the metal ring clamp. Some versions of this system have incorporated a mating tapered interface between the male and female portions. Although these structures have considerably improved the performance of the seal, they have not totally alleviated the leakage problem. Leakage still occurs during service, particularly during surge conditions.

SUMMARY OF THE INVENTION

The present invention provides an improved sealing structure for a hydrocyclone which includes a lower cone section and an upper head section, each of which carry circumferential elements mutually adapted to be pressed together in sealing relationship by external clamp means. This invention contemplates that both of the circumferential elements are substantially of resinous material, typically polyurethane, although these elements themselves may be associated either with resinous or metallic cone and head sections. As presently envisioned, the preferred embodiments of this invention include the circumferential sealing elements as integral portions of polyurethane or other resinous cone and head structures.

According to this invention, one of the sealing elements, usually that associated with the head, carries a circumferential extension, which may be regarded as the male member of a connector, with an internal surface configurated to merge smoothly with the internal surface of the hydrocyclone, and with an external surface shaped as a male taper. The distal end of the extension carries an internal surface shaped as a female taper. The other sealing element carries surfaces adapted to mate with the male and female tapers, respectively, of the first sealing element. A double taper seal is thus effected when the two sealing elements are pressed into contact by connecting the head and cone section in conventional fashion with an external clamp means.

Although the seal structure of this invention may be adapted to cyclones of various dimensions, it is presently anticipated that it will find most use in hydrocyclone of resinous construction having diameters within the range of about two inches to about twelve inches. It is particularly adapted for the hydrocyclone normally used in the surface mud handling systems of drilling rigs wherein drilling mud is delivered to the head of the hydrocyclone by means of a horizontal centrifugal mud pump with an output pressure in excess of about 50 psi.

BRIEF DESCRIPTION OF THE DRAWINGS

In the drawings, which illustrate what is presently regarded as the best mode for carrying out the invention.

DESCRIPTION OF THE ILLUSTRATED EMBODIMENTS

Figures 1, 2:
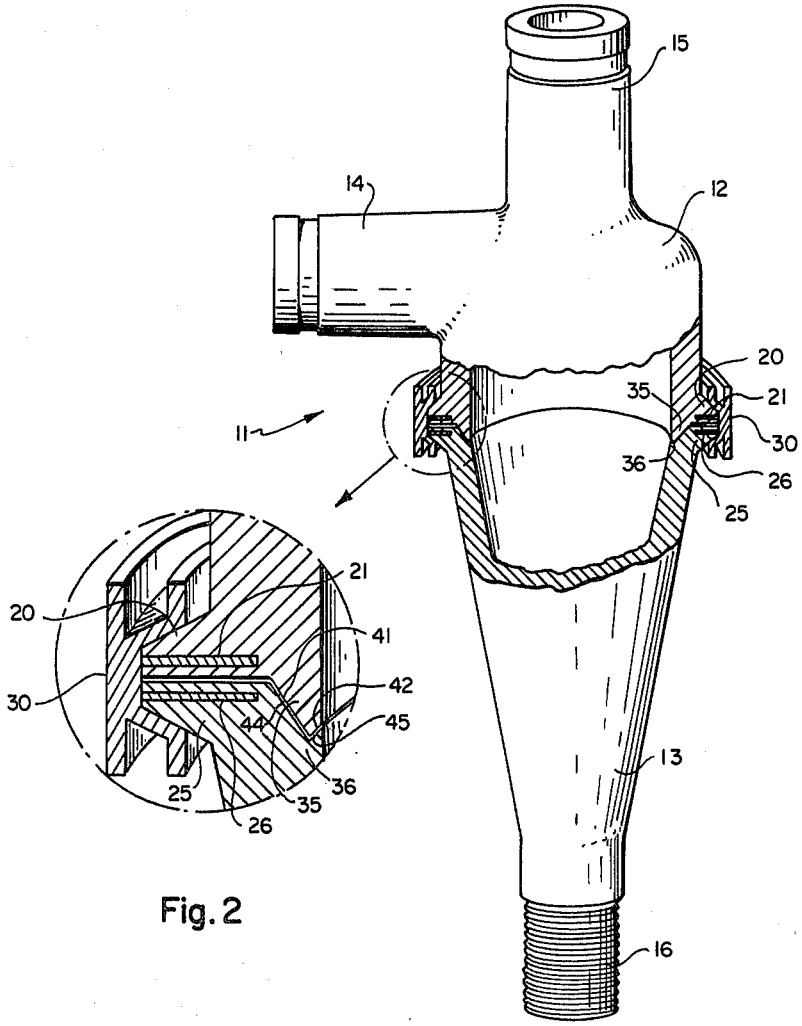
FIG. 1 is a pictorial view partially broken away of a hydrocyclone with the improved sealing structure of this invention.
FIG. 2 is an enlarged view of a portion of the hydrocyclone shown by FIG. 1.

As may be seen from FIG. 1, a typical hydrocyclone, designated generally 11, includes a head section 12 and a lower cone section 13. The head section 12 includes an inlet 14 and an overflow 15, both adapted for connection to appropriate piping. The cone section 13 terminates in an underflow with a threaded end 16 adapted to a standard tri-nut assembly (not shown).

The head section 12 carries an upper flange 20 with a steel reinforcing ring 21. The cone section 13 carries a lower flange 25 with a steel reinforcing ring 26. The flanges 20, 25 are pressed towards each other by tightening a stainless steel clamp 30.

As the flanges 20, 25 are drawn together by reducing the circumference of the clamp 30, an upper circumferential sealing element 35 is brought into mating contact with a lower sealing element 36.

As best seen from FIG. 2, the upper sealing member 35 has an external surface shaped as a male taper 41. The internal perimeter of the element 35 is adapted as a female taper 42. The tapers 41 and 42 register with corresponding opposite internal tapers 44 and 45 carried by the sealing element 36 associated with the lower cone 13.

In practice, it has been found that hydrocyclone assembled as shown in the drawings and constructed of a polyurethane elastomer produced by curing a polyether-based liquid polymer (sold under the trademark VIBRATHANE by Uniroyal Chemical of Nangatuck, Conn.) will withstand pressures in excess of 90 psi without leaking. Such pressures may be applied in surges or under steady conditions for prolonged periods without breaking the seal.

Reference herein to details of the illustrated embodiments is not intended to limit the scope of the claims, which themselves recite those details regarded as essential to the invention.

I claim:

1. In a hydrocyclone including a lower cone section and an upper head section, each carrying circumferential elements mutually adapted to be pressed together in sealing relationship by reducing the circumference of external circumferential clamp means, wherein both elements are substantially of resinous material, the improvement which comprises configurating one of said elements as an extension with an external surface shaped as a male taper and an internal surface shaped as a female taper terminating at the interior surface of said hydroclone, and providing the other of said elements with an internal surface adapted to mate with said male taper and an internal structure adapted to mate with said female taper, thereby effecting a double taper seal when the two sections are connected by said external clamp means and the circumference of said clamp means is reduced.

2. An improvement according to claim 1 wherein said extension is carried by the head section.

3. An improvement according to claim 1 wherein both elements are constructed of a polyurethane material.

4. An improvement according to claim 3 wherein said extension is carried by the head section.

5. An improvement according to claim 1 wherein the internal diameter of said head section is between about two inches and about twelve inches

6. An improvement according to claim 1 wherein said head section and lower cone section each carry external flanges in the proximity of said sealing elements, and said sections are urged together by means of an external clamping band adapted to said flanges.

7. An improvement according to claim 6 wherein said hydrocyclone is constructed substantially of polyurethane material.

8. An improvement according to claim 7 wherein said extension is carried by the head section.

* * * * *